US007694962B2

(12) United States Patent
Morya et al.

(10) Patent No.: US 7,694,962 B2
(45) Date of Patent: Apr. 13, 2010

(54) SHEET CONVEYING APPARATUS AND IMAGE FORMING APPARATUS

(75) Inventors: Masaaki Morya, Moriya (JP); Hidehiko Kinoshita, Kashiwa (JP); Jun Yamaguchi, Fujisawa (JP); Atsushi Nakagawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 11/945,722

(22) Filed: Nov. 27, 2007

(65) Prior Publication Data

US 2008/0128980 A1 Jun. 5, 2008

(30) Foreign Application Priority Data

Dec. 4, 2006 (JP) ..... 2006-327528

(51) Int. Cl.
*B65H 7/02* (2006.01)

(52) U.S. Cl. ..... 271/228; 271/227

(58) Field of Classification Search ..... 271/227, 271/228, 270

See application file for complete search history.

(56) References Cited

U.S. PATENT DOCUMENTS

| | | | | |
|---|---|---|---|---|
| 4,971,304 | A * | 11/1990 | Lofthus | 271/227 |
| 5,169,140 | A * | 12/1992 | Wenthe, Jr. | 271/228 |
| 5,172,907 | A * | 12/1992 | Kalisiak | 271/227 |
| 5,580,042 | A | 12/1996 | Taniguro et al. | 271/274 |
| 5,620,174 | A | 4/1997 | Taniguro et al. | 271/10.12 |
| 5,672,019 | A | 9/1997 | Hiramatsu et al. | 400/624 |
| 5,681,036 | A * | 10/1997 | Wakahara et al. | 271/10.12 |
| 5,725,319 | A | 3/1998 | Saito et al. | 400/629 |
| 6,168,270 | B1 | 1/2001 | Saikawa et al. | 347/104 |
| 6,778,787 | B2 | 8/2004 | Kinoshita et al. | 399/21 |
| 6,915,088 | B2 | 7/2005 | Nakagawa et al. | 399/66 |
| 7,258,340 | B2 * | 8/2007 | Clark et al. | 271/228 |
| 7,422,210 | B2 * | 9/2008 | Dejong et al. | 271/228 |
| 2008/0136094 | A1 * | 6/2008 | Elliot | 271/270 |

FOREIGN PATENT DOCUMENTS

| | | | |
|---|---|---|---|
| JP | 63267639 | A * | 11/1988 |
| JP | 10-32682 | | 2/1998 |

* cited by examiner

*Primary Examiner*—Patrick H Mackey
*Assistant Examiner*—Luis Gonzalez
(74) *Attorney, Agent, or Firm*—Fitzpatrick, Cella, Harper & Scinto

(57) ABSTRACT

When a comparative determination portion determines that passage of a sheet through a reference position is lagged based on a detecting signal from a passing timing detection unit, a sheet conveying speed of a skew feeding correction roller on the same side as that of a sensor which detects the lagged sheet in two sensors is increased to correct sheet skew feeding. When the comparative determination portion determines that passage of a sheet through a reference position is leaded, the sheet conveying speed of the skew feeding correction roller on the same side as that of a sensor which detects the leaded sheet in the two sensors is reduced to correct sheet skew feeding.

7 Claims, 27 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, particularly to a configuration for correcting skew feeding of a sheet such as recording paper to an image forming portion.

2. Description of the Related Art

Conventionally, the image forming apparatus such as a copying machine a printer, and a facsimile includes the sheet conveying apparatus which conveys the sheet such as the recording paper in the image forming portion. Some examples of sheet conveying apparatus include skew feeding correction portions which correct the sheet skew feeding to align an attitude and a position of the sheet until the sheet is conveyed to the image forming portion.

In such skew feeding correction portions, a loop is formed in the sheet with a pair of registration rollers to correct the skew feeding. However, because the sheet is temporarily stopped, a time necessary to correct the skew feeding becomes lengthened.

Therefore, in order to shorten the time necessary to correct the skew feeding, there is an active registration method in which the sheet is rotated to correct the skew feeding while conveying the sheet using two sensors and two pairs of skew feeding correction rollers independently rotated (see, for example, Japanese Patent Publication Laid-Open No. 10-032682).

In the active registration method, the skew feeding is detected at a front end of the sheet based on a sheet detecting signals from the two sensors when the front end of the sheet transverses the sensors provided on a coaxial line orthogonal to a sheet conveying direction in a sheet conveying path.

Then, a sheet skew feeding amount is detected based on the sheet detecting signals from the two sensors. Then, rotating speeds of two drive motors for driving two pairs of skew feeding correction rollers are controlled according to the detected skew feeding amount, whereby the sheet conveying speeds of the two pairs of skew feeding correction rollers are changed to correct the sheet skew feeding according to the sheet skew feeding amount.

During the skew feeding correction, the sheet conveying speed of one of the pairs of skew feeding correction rollers is reduced (referred to as skew feeding speed reducing control) or increased (referred to as skew feeding speed-increasing control) with respect to the other pair of skew feeding correction rollers according to the sheet skew feeding amount, thereby correcting the sheet skew feeding.

In the active registration method, because the skew feeding is corrected without tentatively interrupting the sheet conveyance, a sheet interval (interval between a precedence sheet and a following sheet) can be narrowed compared with other methods. Therefore, sheet conveying efficiency can be enhanced, and an overall image forming speed can substantially be improved without increasing an image forming process speed in the image forming apparatus. Recently, the image forming process speed has tended to increase and, accordingly, the active registration method can provide speed enhancements of the sheet conveyance process to match such speed enhancements of the image forming operation in the image forming apparatus.

In the conventional image forming apparatus including the skew feeding correction portion having the above configuration, it is necessary to correct a position in the sheet conveying direction in addition to the sheet skew feeding correction.

Therefore, for example, the conventional image forming apparatus includes a correction roller which is located on a downstream side of the skew feeding correction roller to correct the position in the sheet conveying direction. After the skew feeding is corrected by the skew feeding correction roller, the rotating speed of the correction roller is controlled to change the sheet conveying speed such that the sheet is conveyed at ideal timing at which the front end of a toner image is aligned with the front end of the sheet.

However, in the case where the sheet conveying speed of the skew feeding correction roller is controlled for the skew feeding correction, the position of the sheet fluctuates in the sheet conveying direction depending on the decrease in speed on the sheet preceding side or the increase in speed on the sheet following side.

For example, the sheet conveyance tends to be delayed (lagging) in the case of the skew feeding speed-reducing control. Therefore, sheet conveying lag is increased when the sheet conveyance is lagging compared to a skew feeding correction start position. As used herein, the sheet conveying lag shall mean that the sheet conveyance is lagging compared with the timing of the ideal sheet conveyance.

The sheet conveyance tends to be advanced (leading) in the case of the skew feeding speed-increasing control. Therefore, sheet conveying lead is increased when the sheet conveyance is leading compared to the skew feeding correction start position. As used herein, the sheet conveying lead shall mean that the sheet conveyance is leading compared with the timing of the ideal sheet conveyance.

That is, when skew feeding correction is performed by the skew feeding correction roller, the sheets after skew feeding correction may have a lag amount or lead amount which should be corrected in a correction roller located on the downstream side of the skew feeding correction rollers. The lag amount may be especially serious when the speed-reducing correction is performed on a sheet which reached the skew feeding correction rollers in the sheet conveying lag state. Similarly, the lead amount may be especially serious when the speed-increasing correction is performed on a sheet which reached the skew feeding correction rollers in the sheet conveying lead state. In such cases, a sheet conveying speed of the downstream correction roller may be increased or decreased temporarily (with respect to a normal or target speed) to correct for the lag amount or the lead amount of the sheet after skew feeding correction. In particular, a speed-increasing period or a speed-reducing period of the correction roller is increased to lengthen the time for which the sheet conveying speed of the downstream correction roller is increased or decreased with respect to the target speed during the correction. However, because a probability of generating slip of the correction roller is increased during the speed-increasing period or speed-reducing period, accuracy of positional correction may in practice be decreased in the sheet conveying direction.

As shown in FIG. 15, in the actual speed control of the downstream correction roller, the speed is changed in a stepwise manner, and the correction time is limited to integer multiples of a period of the target speed V1. Therefore, an error is generated with respect to an ideal analog waveform, and an amount of error is increased as the speed-increasing period or speed-reducing period is broadened, whereby the correction accuracy is decreased.

SUMMARY OF THE INVENTION

It is desirable to provide an image forming apparatus which can correct the sheet skew feeding without worsening the sheet conveying lag or sheet conveying lead.

In accordance with an aspect of the invention, a sheet conveying apparatus comprising:

a skew feeding detection unit arranged along a sheet conveying path which detects a skew-feeding state of a conveyed sheet;

a skew feeding correction device, arranged along the sheet conveying path, and comprising first and second skew feeding correction rollers that are drivable independently and are arranged respectively at a direction orthogonal to a sheet conveying direction;

a drive control unit operable to control driving of the skew feeding correction rollers so as to correct for the skew feeding of the sheet based on a direction by the skew feeding detection unit; and a lag/lead state detection unit which detects whether such a conveyed sheet reaches a reference position disposed at the sheet conveying path in a lag state in which conveyance of the sheet is lagging, or in a lead state in which conveyance of the sheet is leading;

wherein the drive control unit are operable to control said driving of the skew feeding correction rollers in dependence upon the detected lag state or lead state such that an amount of the lag or lead of the sheet after such skew feeding correction by the skew feeding correction device becomes smaller than that at the reference position.

In accordance with an aspect of the invention, an image forming apparatus comprising:

a skew feeding detection unit arranged along a sheet conveying path which detects a skew-feeding state of a conveyed sheet;

a skew feeding correction device, arranged along the sheet conveying path, and comprising first and second skew feeding correction rollers that are drivable independently and are arranged respectively at a direction orthogonal to a sheet conveying direction;

a drive control unit operable to control driving of the skew feeding correction rollers so as to correct for the skew feeding of the sheet based on a direction by the skew feeding detection unit;

an image forming portion operable to form an image and to transfer the image onto a conveyed sheet following correction of skew feeding by the skew feeding correction device, and a lag/lead state detection unit which detects whether such a conveyed sheet reaches a reference position disposed along the sheet conveying path in a lag state in which conveyance of the sheet is lagging, or in a lead state in which conveyance of the sheet is leading, wherein the reference position is set in order to determine whether the sheet, on which the image is to be transferred at a transfer portion of the image forming portion, is being conveyed with the lag or the lead;

wherein the drive control unit are operable to control said driving of the skew feeding correction rollers in dependence upon the detected lag state or lead state such that an amount of the lag or lead of the sheet after such skew feeding correction by the skew feeding correction device becomes smaller than that at the reference position.

Further features of the present invention will become apparent from the following description of exemplary embodiments (with reference to the attached drawings).

DESCRIPTION OF THE EMBODIMENTS

Preferred embodiments of the invention will be described below with reference to the drawings.

Figure 1:
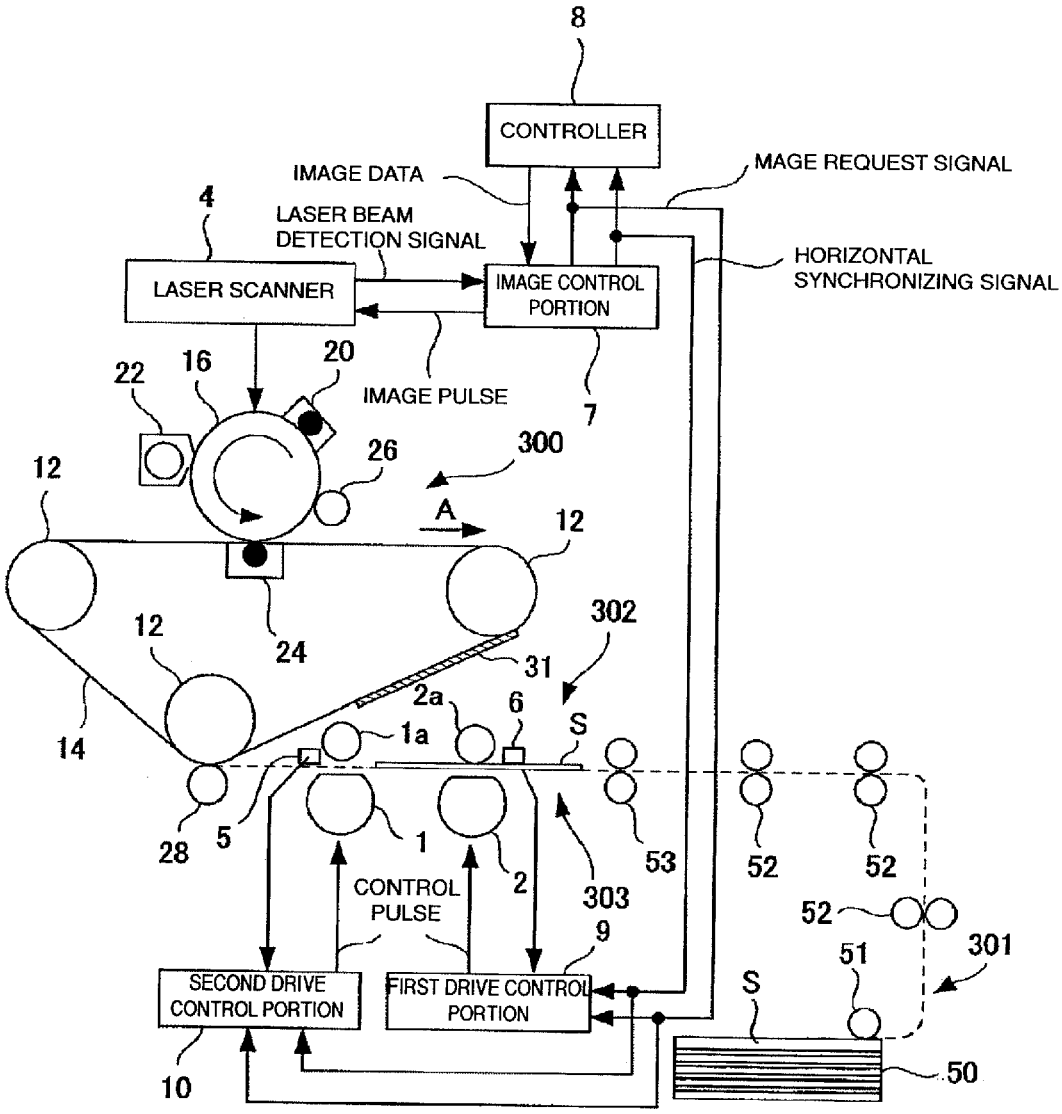
FIG. 1 shows a configuration of an image forming apparatus according to a first embodiment of the invention.

FIG. 1 shows a configuration of an image forming apparatus according to a first embodiment of the invention. Referring to FIG. 1, an image forming portion 300 forms an image on a sheet, and a sheet feeding portion 301 feeds a sheet S to the image forming portion 300.

A photosensitive drum 16 which is of an image bearing member and a laser scanner 4 are provided in the image forming portion 300. The laser scanner 4 irradiates the photosensitive drum 16 with a laser beam based on image information to form an electrostatic latent image on the photosensitive drum 16. The photosensitive drum 16 is driven by a motor (not shown) A charger 20 which evenly charges the photosensitive drum 16 is disposed on an upstream side of a position, where the laser scanner 4 irradiated the photosensitive drum 16 with the laser beam, in a rotating direction of the photosensitive drum 16. A development device 22 and a cleaner 26 are disposed on a downstream side of the laser beam irradiation position. The development device 22 forms a toner image by developing the electrostatic latent image, formed on the photosensitive drum 16, using toner.

An endless transfer belt 14 and a secondary transfer roller 28 are provided in the image forming portion 300 to constitute a secondary transfer portion. The endless transfer belt 14 is entrained about a roller 12, and the endless transfer belt 14 transfers the toner image to the sheet S after the toner image is transferred and formed. The secondary transfer roller 28 transfers the toner image from the transfer belt 14 to the sheet S. A primary transfer charger 24 is disposed across the transfer belt 14 from the photosensitive drum 16 to constitute a primary transfer portion. The primary transfer charger 24 transfers a toner image 31 from the photosensitive drum 16 to the transfer belt 14.

A cassette 50 is provided in the sheet feeding portion 301. The cassette 50 is detachably attached to an apparatus main body (not shown) while accommodating the sheet S such as the recording paper and OHP sheet. The sheet S is supplied from the cassette 50 toward the image forming portion 300 using a sheet feeding roller 51.

A sheet conveying apparatus 302 provided between the sheet feeding portion 301 and the image forming portion 300 to convey the sheet S, fed from the sheet feeding portion 301, to the secondary transfer portion of the image forming portion 300. A skew feeding correction portion (A skew feeding correction device) 303 is provided in the sheet conveying apparatus 302. The skew feeding correction portion 303 enhances the accuracy of the attitude and position of the sheet S, and the skew feeding correction portion 303 properly delivers the sheet S in synchronization with the toner image on the transfer belt. The sheet is conveyed based on the center in a width direction orthogonal to the sheet conveying direction (so-called center base).

In FIG. 1, an image control portion 7 receives a laser beam detecting signal from the laser scanner 4, and the image control portion 7 transmits an image pulse corresponding to the image data to the laser scanner 4 in synchronization with the received laser beam detecting signal. The laser beam detecting signal transmitted when the laser beam sensor detects the laser beam reflected by a polygon mirror incorporated into the laser scanner 4 to deflect the laser beam.

A controller 8 stores the image data transmitted from PC or a reader, and the controller 8 transmits the image data to the image control portion 7 based on an image request signal and a horizontal synchronizing signal from the image control portion 7. The horizontal synchronizing signal is generated based on the laser beam detecting signal. After the predetermined number of horizontal synchronizing signals is counted based on the image request signal, the controller 8 synchronizes the image data with the horizontal synchronizing signal to transmit the horizontal synchronizing signals to the image control portion 7 in each predetermined number of lines.

The image control portion 7 converts the image data into the image pulse having a pulse width corresponding to a data level of the image data. For example, the image control portion 7 generates the image request signal by receiving a trigger signal from CPU (not shown) which performs a sequence of the whole apparatus.

An image forming operation of the image forming apparatus having the above configuration will be described below.

When the image control portion 7 receives the trigger signal from CPU (not shown), the image control portion 7 outputs the image request signal to the controller 8, and the controller 8 transmits the image data and the horizontal synchronizing signal while synchronizing the image data with the horizontal synchronizing signal using the image request signal. Then, the image control portion 7 transmits the image pulse to the laser scanner 4 according to the image data.

Then, the laser scanner 4 irradiates the photosensitive drum 16 rotated counterclockwise with the laser beam corresponding to the image pulse or the laser beam modulated based on the image data corresponding to data from an image memory (not shown).

At this point, the photosensitive drum 16 is previously charged by the charger 20, the electrostatic latent image is formed by irradiating the photosensitive drum 16 with the laser beam, and then the electrostatic latent image is developed to form the toner image by the development device 22. Then, in the primary transfer portion, the toner image formed on the photosensitive drum 16 is transferred onto the transfer belt 14 by action of a primary transfer bias voltage applied to the primary transfer charger 24.

On the other hand, the sheet feeding roller 51 delivers the sheet S from the cassette 50 in synchronization with the trigger which is transmitted from CPU such that the position of the sheet S is aligned with the position of the toner image 31 on the transfer belt 14. Then, the sheet S is conveyed to pre-registration rollers 53 through conveying rollers 52. Sensors (not shown) are disposed near the conveying rollers 52 respectively. The CPU drives the conveying rollers 52 using a drive control portion (not shown) based on the sheet passage detected by the sensors.

The sheet S is conveyed to the skew feeding correction portion 303, and the pre-registration roller 53 corrects the skew feeding when the sheet S passes through the skew feeding correction portion 303. Then, the sheet S is delivered at the right timing to the secondary transfer portion including the transfer belt 14 and the secondary transfer roller 28.

The secondary transfer roller 28 transfers the toner image onto the sheet S delivered to the secondary transfer portion, and the sheet S is conveyed to the fixing portion (not shown). Then, the sheet S is heated and pressurized by the fixing portion, whereby the unfixed transferred image is permanently fixed to sheet S.

The skew feeding correction portion (skew feeding correction device) 303 includes two pairs of skew feeding correction rollers 2, a front-end registration roller (sheet conveying device) 1, a first sensor portion (sheet position detection unit) 5, and a second sensor portion (skew feeding detection unit) 6. The two pairs of skew feeding correction rollers 2 are independently driven. The first and second sensor portions 5 and 6 form part of the detection unit. The skew feeding correction portion 303 also includes a first drive control portion (drive control unit) 9 and a second drive control portion (further drive control unit) 10. The first drive control portion 9 controls the drive of the skew feeding correction roller pair 2 and the second drive control portion 10 controls the drive of the front-end registration roller 1.

Figure 2:
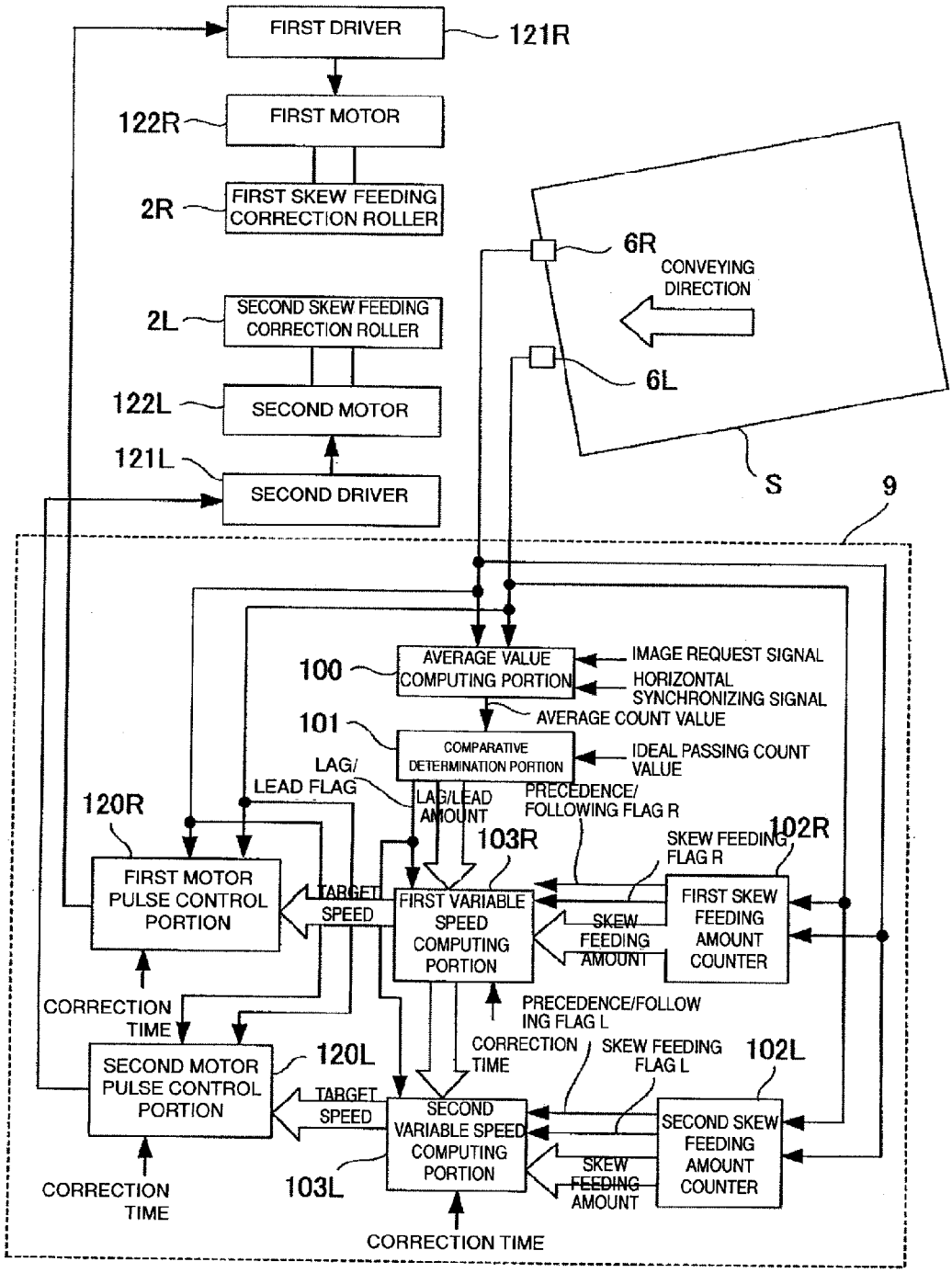
FIG. 2 shows a configuration of a first drive control portion of a skew feeding correction roller provided in the image forming apparatus.

As shown in FIG. 2, the second sensor portion 6 includes plural sensors, e.g., first and second sensors 6R and 6L located on the right and left sides. When the first and second sensors 6R and 6L detect a front end of the sheet S, first and second skew feeding correction rollers 2R and 2L are started up. The first and second skew feeding correction rollers 2R and 2L are independently controlled by first and second motors 122R and 122L.

Each of the pair of first and second skew feeding correction rollers 2R and 2L is partly cut out (see FIG. 1). On standby for the sheet conveyance, the first and second skew feeding correction rollers 2R and 2L are stopped at the positions where the cut-out portions are orientated upward, and the first and second skew feeding correction rollers 2R and 2L are separated from driven rollers 2*a* located above. Marks (not shown) are provided in the first and second skew feeding correction rollers 2R and 2L. When home position sensors (not shown) detect the marks, detecting signals are inputted to first and second motor pulse control portions 120R and 120L provided in the first drive control portion 9.

On standby for the sheet conveyance, the first and second motor pulse control portions 120R and 120L control the first and second motors 122R and 122L through first and second drivers 121R and 121L based on the detecting signals. Therefore, the first and second skew feeding correction rollers 2R and 2L can be stopped at the positions where the cut-out portions are orientated upward.

The first drive control portion 9 controls the skew feeding correction of the sheet S based on the detecting signals of the first and second sensors 6R and 6L, the image request signal, and the horizontal synchronizing signal. As shown in FIG. 2, in addition to the first and second motor pulse control portions 120R and 120L, the first drive control portion 9 includes a lag/lead state detection unit which has an average value computing portion (passing timing detection unit) 100 and a comparative determination portion (comparative determination unit) 101, and first and second skew feeding amount counters 102R and 102L, and first and second variable speed computing portions 103R and 103L.

Figure 3:
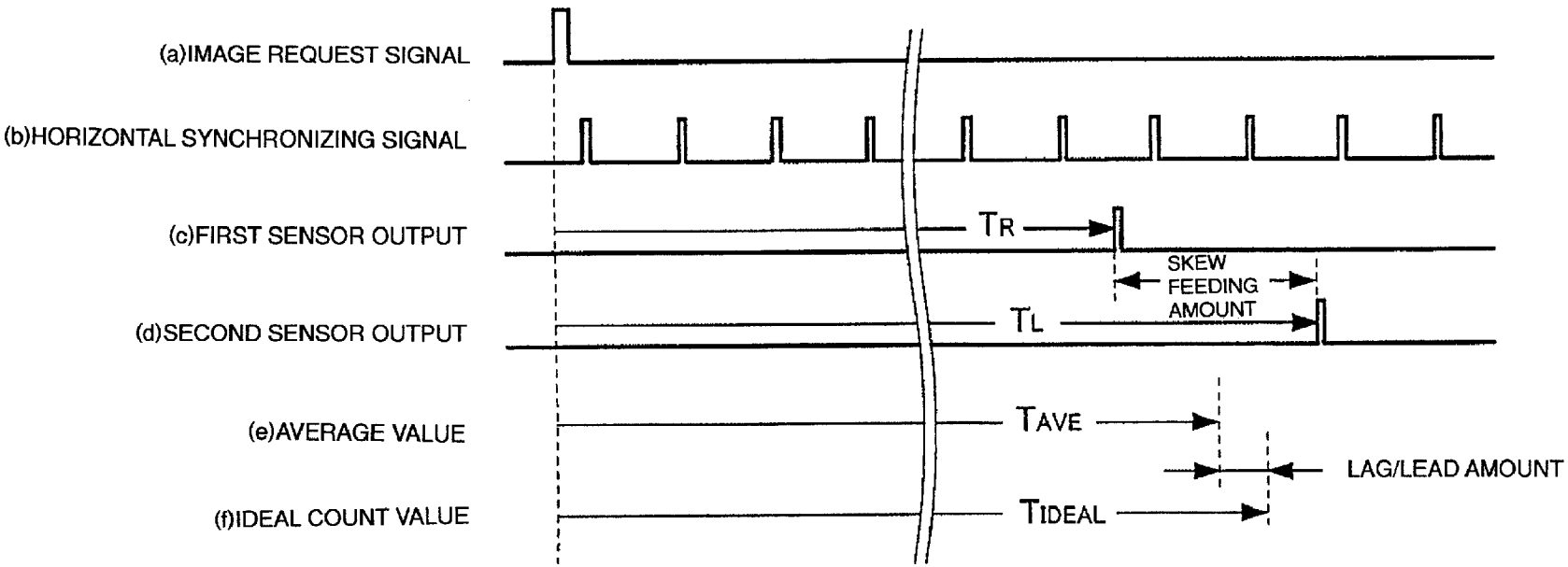
FIG. 3 is a timing chart showing a conveying lag/lead count of the image forming apparatus.

The average value computing portion 100 counts the horizontal synchronizing signal shown in FIG. 3(*b*) based on the image request signal (image forming signal) shown in FIG. 3(*a*). The average value computing portion 100 also counts the number of clocks based on the horizontal synchronizing signal, and the average value computing portion 100 latches count values (TR and TL) of FIGS. 3(*c*) and 3(*d*) at times when the first and second sensors 6R and 6L detects the sheet S. The average value computing portion 100 computes an average value (TAVE) of the count values (TR and TL) as shown in FIG. 3(*e*). The average value computing portion 100 detects passage timing of the conveyed sheet through a reference position. The reference position is set in order to determine whether the sheet, on which the image is to be transferred at the second transfer portion, is being conveyed with a lag or a lead.

At this point, the average value (TAVE) computed by the average value computing portion 100 (which is part of the passing timing detection unit) indicates timing at which the sheet S passes through a midpoint between the first and second sensors 6R and 6L (center point in a line connecting the first and second sensors 6R and 6L) which are of a reference position whether or not the sheet S passes through. Although the reference position is set to the midpoint between the first and second sensors 6R and 6L in the first embodiment, the reference position may be set using sensors which are located in other suitable positions near the first and second sensors 6R and 6L and which are able to provide a reference position at or in the vicinity of the center in the width direction of the sheet.

The comparative determination portion 101 compares the average value (TAVE) to an ideal passing count value (TIDEAL) shown in FIG. 3(*f*). This ideal passing count value TIDEAL is the value at which the sheet S should pass through the reference position (midpoint of the first and second sensors 6R and 6L) to align the toner image 31 with the sheet S. As a result of the comparison, the comparative determination portion 101 determines whether the timing at which the sheet S passes through the reference position is lagging or leading, and the comparative determination portion 101 outputs a lag/lead flag (lag: 0 or lead: 1) and a lag/lead amount to first and second variable speed computing portions 103R and 103L.

The first and second skew feeding amount counters 102R and 102L are skew feeding amount detection units which detect the sheet skew feeding amounts based on the signals from the first and second sensors 6R and 6L. The outputs from the first and second sensors 6R and 6L are inputted to the first and second skew feeding amount counters 102R and 102L. The first skew feeding amount counter 102R outputs a preceding/following flag R (preceding: 1 or following: 0) as a signal for determining whether or not the output of the first sensor 6R precedes the output of the second sensor 6L, and the first skew feeding amount counter 102R also outputs a difference in output between the first and second sensors 6R and 6L as the skew feeding amount. When the first and second sensors 6R and 6L output the signals at the same time, the first skew feeding amount counter 102R outputs a skew feeding flag R (=0). The first skew feeding amount counter 102R outputs the skew feeding flag R (=1) when the sheet S is in the skew feeding state.

The second skew feeding amount counter 102L outputs a preceding/following flag L (preceding: 1 or following: 0) as a signal for determining whether or not the output of the second sensor 6L precedes the output of the first sensor 6R, and the second skew feeding amount counter 102L also outputs a difference in output between the first and second sensors 6R and 6L as the skew feeding amount. When the first and second sensors 6R and 6L output the signals at the same time, the second skew feeding amount counter 102L outputs a skew feeding flag L (=0). The second skew feeding amount counter 102L outputs the skew feeding flag L (=1) when the sheet S is in the skew feeding state.

When the sheet S passes through the first sensor 6R before the second sensor 6L, the first variable speed computing portion 103R computes a target speed V1 which increases or reduces a sheet conveying speed of the first skew feeding correction roller 2R from a steady speed V0 according to the lag or lead of the sheet S.

In computing the target speed V1, a speed-changing amount is obtained by dividing the skew feeding amount by a set correction time (time obtained by subtracting a transition time from an actual correction time). This speed-changing amount is then subtracted from the steady speed (normal speed) V0 such that an area of a trapezoid of a speed-changing region shown in FIGS. 5 to 12 is equal to the skew feeding amount.

When the sheet S passes through the second sensor 6L before the first sensor 6R, the second variable speed computing portion 103L computes a target speed V1 which increases or reduces the sheet conveying speed of the second skew feeding correction roller 2L from the steady speed V0 according to the lag or lead of the sheet S. The target speed V1 of the second skew feeding correction roller 2L is computed in the same way as for the first skew feeding correction roller 2R.

As described above, the first and second motor pulse control portions 120R and 120L control the first and second motors 122R and 122L through the first and second drivers 121R and 121L. On the basis of the target speeds V1 computed by the first and second variable speed computing portions 103R and 103L, the first and second skew feeding correction rollers 2R and 2L are rotated at the target speeds V1 by controlling step-pulse periods imparted to the first and second motors 122R and 122L.

The second drive control portion 10 controls the sheet conveying speed of the front-end registration roller 1 (which is of the downstream correction roller) to align the toner image 31 with the front end in the sheet conveying direction of the sheet S based on the signal from the first sensor portion 5. The front-end registration roller 1 is provided on the downstream in the sheet conveying direction of the first and second skew feeding correction rollers 2R and 2L and is partially cut out (see FIG. 1). On standby for the sheet conveyance, the front-end registration roller 1 is stopped at the position where the cut-out portion is orientated upward, and the front-end registration roller 1 is separated from a driven roller la located above (see FIG. 1).

A mark (not shown) is provided in the front-end registration roller 1. When a home position sensor (not shown) detects the mark, a detecting signal is inputted to a motor pulse control portion 203 provided in the second drive control portion 10.

On standby for the sheet conveyance, the motor pulse control portion 203 controls a motor 205 through a driver 204 based on the detecting signal. Therefore, the front-end registration roller 1 can be stopped at the position where the cut-out portion is orientated upward.

Figure 4:
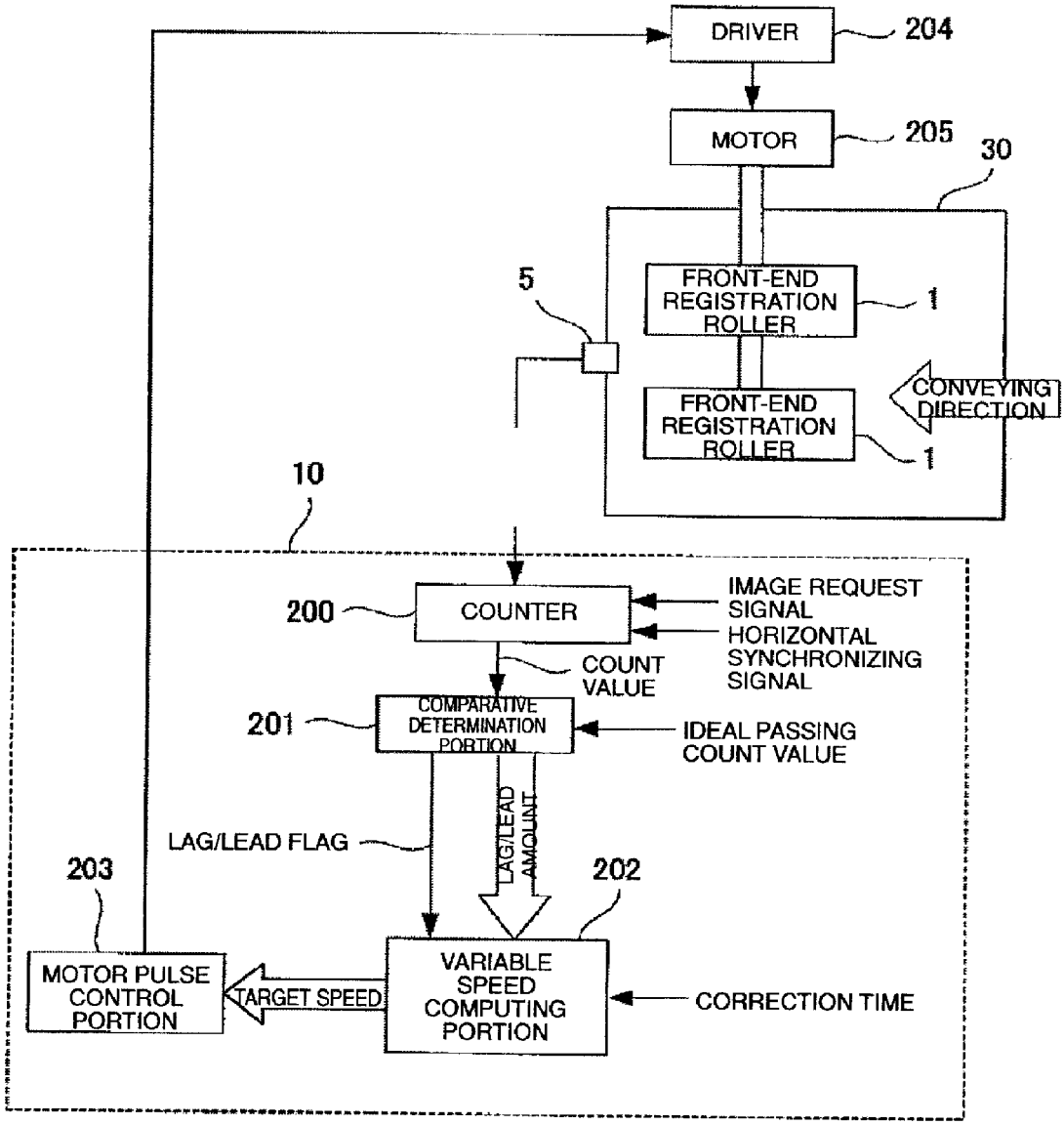
FIG. 4 shows a configuration of a second drive control portion of a front-end registration correction roller provided in the image forming apparatus.

As shown in FIG. 4, in addition to the motor pulse control portion 203, the second drive control portion 10 includes a counter 200, a comparative determination portion 201, and a variable speed computing portion 202.

The first sensor portion 5 outputs the sheet detection to the counter 200, and the counter 200 counts the horizontal synchronizing signal based on the image request signal. The comparative determination portion 201 compares the count value obtained at the time sheet detection output is inputted from the counter 200 to an ideal passing count value (TIDEAL2) at which the sheet S should pass through the first sensor portion 5 to align the toner image 31 with the front end in the sheet conveying direction of the sheet S.

The variable speed computing portion 202 sets the target speed in the sheet conveying direction of the front-end registration roller 1 based on the lag/lead flag (lead: 1 or lag: 0) obtained by the comparison result from the comparative determination portion 201 and the lag/lead amount.

The sheet conveying speed control of the first and second skew feeding correction rollers 2R and 2L in the first drive control portion 9 and the sheet conveying speed control of the front-end registration roller 1 in the second drive control portion 10 will be described below.

When the sheet feeding roller 51 delivers the sheet S from the cassette 50, the sheet S is conveyed to the pre-registration roller 53 through the conveying roller 52. When the first and second sensors 6R and 6L detect the sheet S, the average value computing portion 100 latches the count values (TR and TL) at the time the first and second sensors 6R and 6L detect the sheet S in the first drive control portion 9. Then, the average value computing portion 100 computes the average value (TAVE) of the count values (TR and TL).

Then, the comparative determination portion 101 compares the average value (TAVE) to the ideal passing count value (TIDEAL) in which the sheet S should pass through the midpoint of the first and second sensors 6R and 6L, and the comparative determination portion 101 outputs the lag/lead flag (lag: 0 or lead: 1) and the lag/lead amount.

Figure 5A:
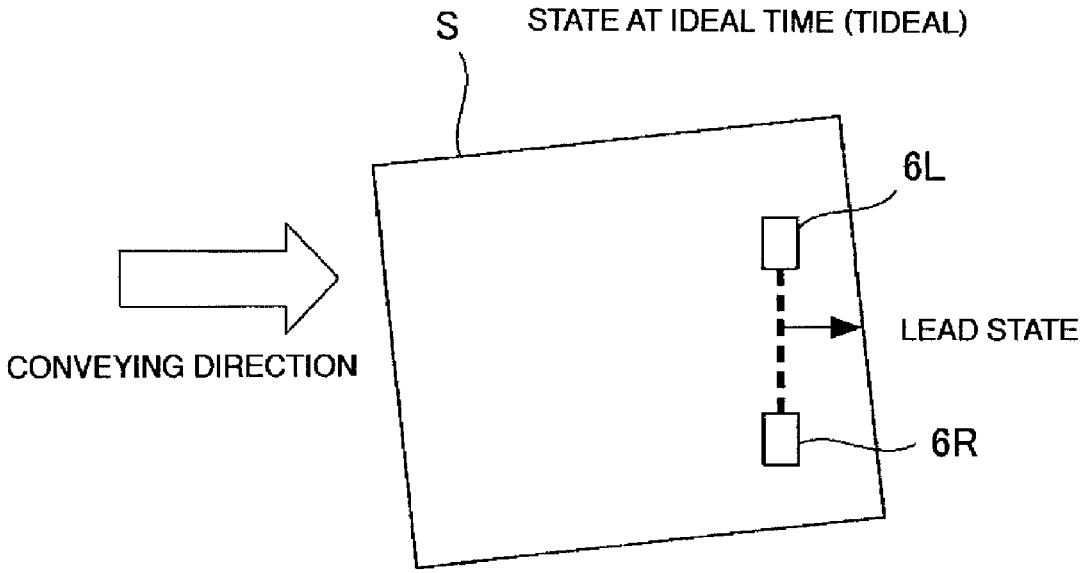
FIG. 5 is a first view illustrating control operation of the first drive control portion of the skew feeding correction roller.

As shown in FIG. 5A, when the sheet S is in the lead state (that is, it passes the reference position before the ideal time TIDEAL) and the sheet S passes through the first sensor 6R before the second sensor 6L, the preceding/following flag R becomes 1 and the lag/lead flag becomes 1 as a result of the comparisons performed by the comparative determination portion 101.

Figure 5B:
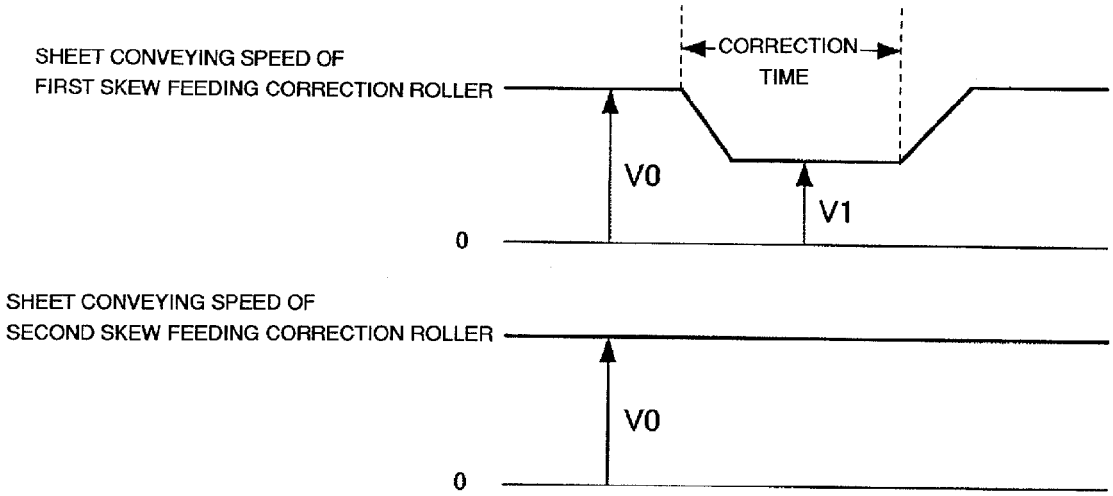

In such a lead state, as shown in FIG. 5B, the first variable speed computing portion 103R computes the target sheet conveying speed V1 of the first skew feeding correction roller 2R. This target speed V1 is reduced from the steady speed V0 of the roller 2R so as to correct for the lead state. Therefore, the first sensor side (R side) of the sheet is lagged, and the skew feeding correction can be finished in the state in which the sheet lead amount becomes smaller than it would have been had the skew feeding correction been done by increasing the speed of the second skew feeding correction roller 2L (as a second mode).

Figure 6A:
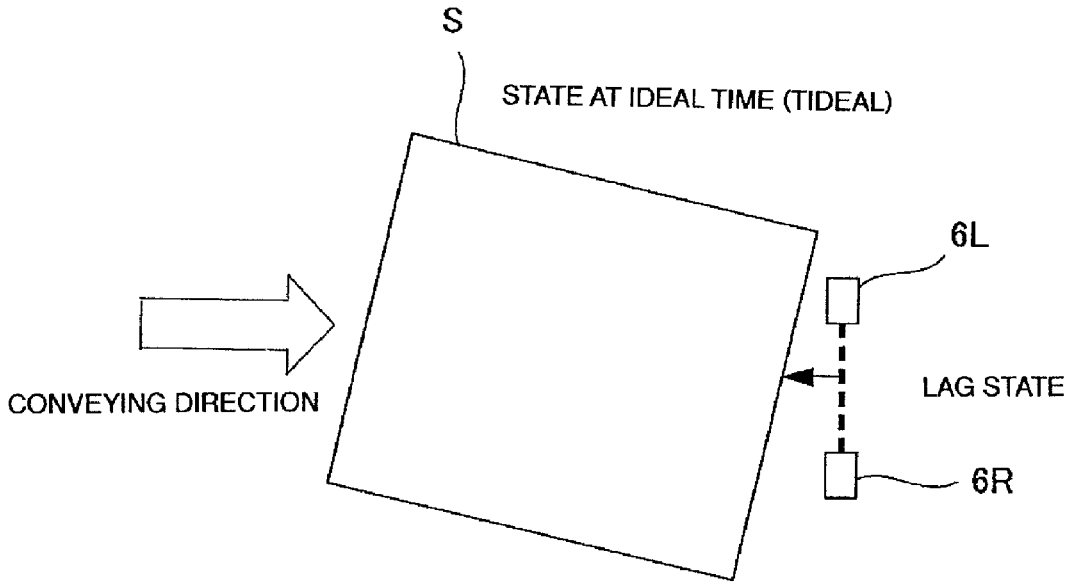
FIG. 6 is a second view illustrating the control operation of the first drive control portion of the skew feeding correction roller.
Figure 6B:
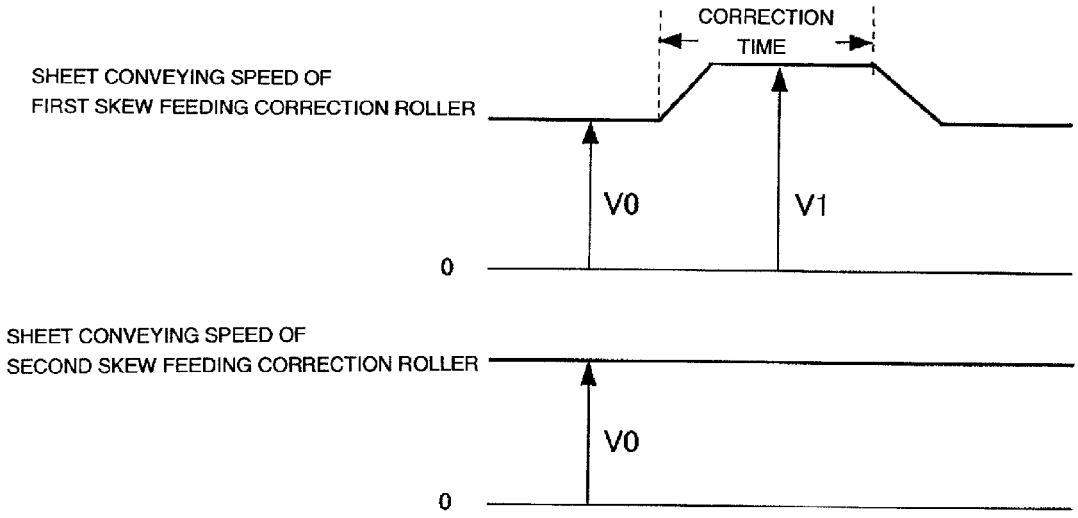

On the contrary, as shown in FIG. 6B, when the sheet S is in the lag state (that is, it passes the reference position after the ideal time TIDEAL) and the sheet S passes through the second sensor 6L before the first sensor 6R, the preceding/following flag R becomes 0 and the lag/lead flag becomes 0 as a result of the comparisons performed by the comparative determination portion 101.

In such a lag state, as shown in FIG. 6B, the first variable speed computing portion 103R computes the target sheet conveying speed V1 of the first skew feeding correction roller 2R. The target speed V1 is increased from the steady speed V0 of the roller 2R so as to correct for the lag state. Therefore, the first sensor side (R side) of the sheet is advanced, and the skew feeding correction can be finished in the state in which the sheet lag amount becomes smaller than it would have been had the correction been done by reducing the speed of the second skew feeding correction roller 2L (as a first mode).

Figure 7A:
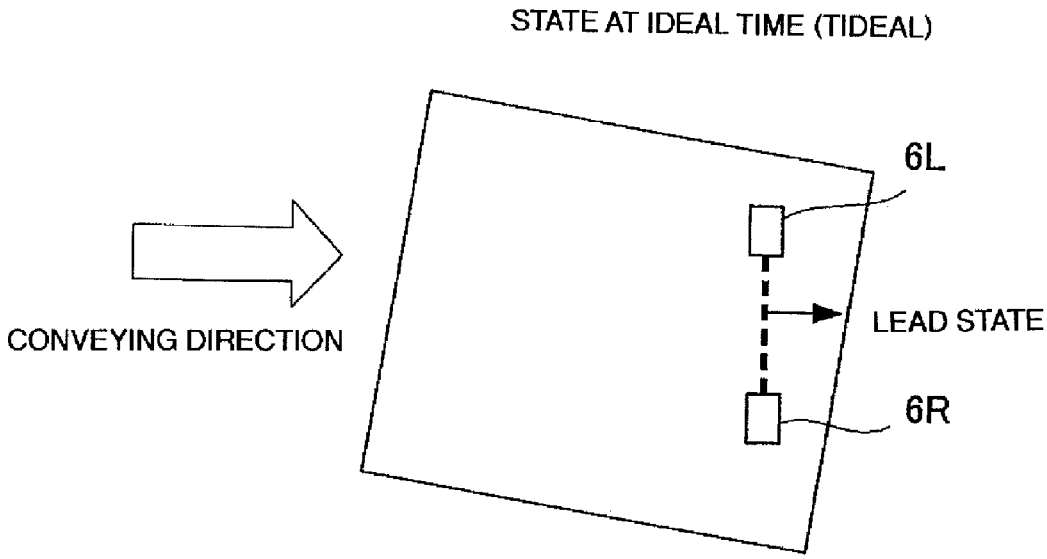
FIG. 7 is a third view illustrating the control operation of the first drive control portion of the skew feeding correction roller.

As shown in FIG. 7A, when the sheet S is in the lead state (that is, it passes the reference position before the ideal time TIDEAL) and the sheet S passes through the second sensor 6L before the first sensor 6R, the preceding/following flag R becomes 1 and the lag/lead flag becomes 1 as a result of the comparisons performed by the comparative determination portion 101.

Figure 7B:
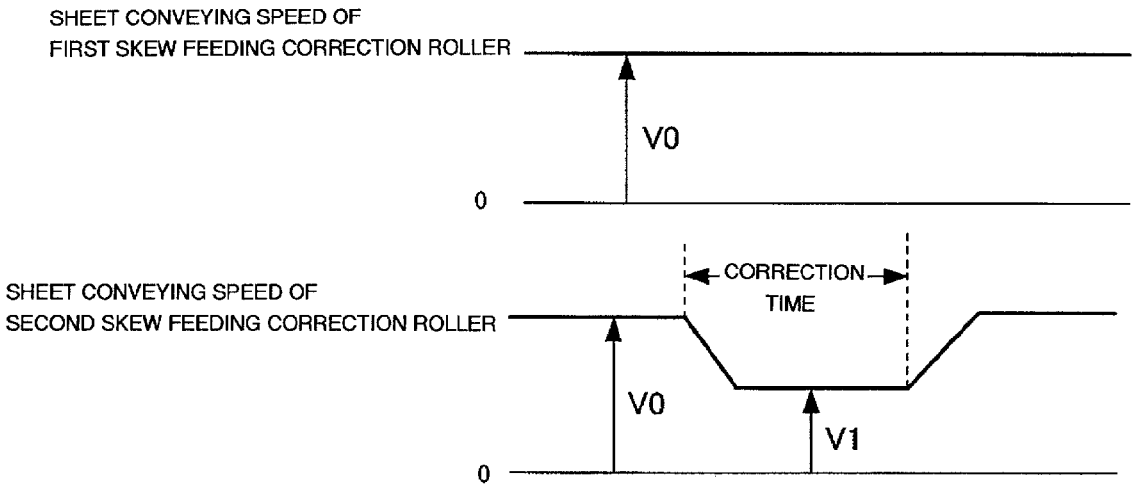

In such a lead state, as shown in FIG. 7B, the second variable speed computing portion 103L computes the target sheet conveying speed V1 of the second skew feeding correction roller 2L. This target speed V1 is reduced from the steady speed V0 of the roller 2L so as to correct for the lead state. Therefore, the second sensor side (L side) of the sheet is lagged, and the skew feeding correction can be finished in the state in which the sheet lead amount becomes smaller than it would have been had the skew feeding correction by increasing the speed of the first skew feeding correction roller 2R (as a second mode).

Figure 8A:
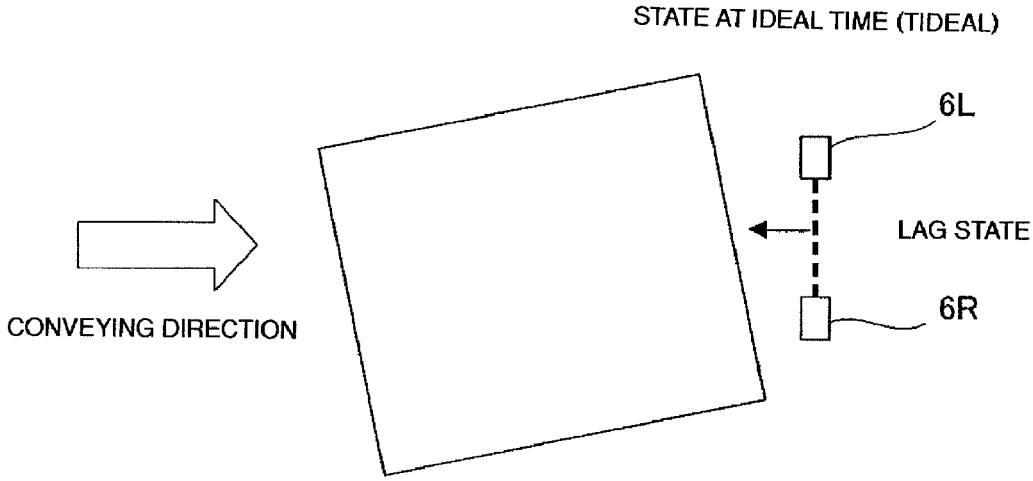
FIG. 8 is a fourth view illustrating the control operation of the first drive control portion of the skew feeding correction roller.

On the contrary, as shown in FIG. 8A, when the sheet S is in the lag state (that is, it passes the reference position after the ideal time TIDEAL) and the sheet S passes through the first sensor 6R before the second sensor 6L, the preceding/following flag R becomes 0 and the lag/lead flag becomes 0 as a result of the comparisons performed by the comparative determination portion 101.

Figure 8B:
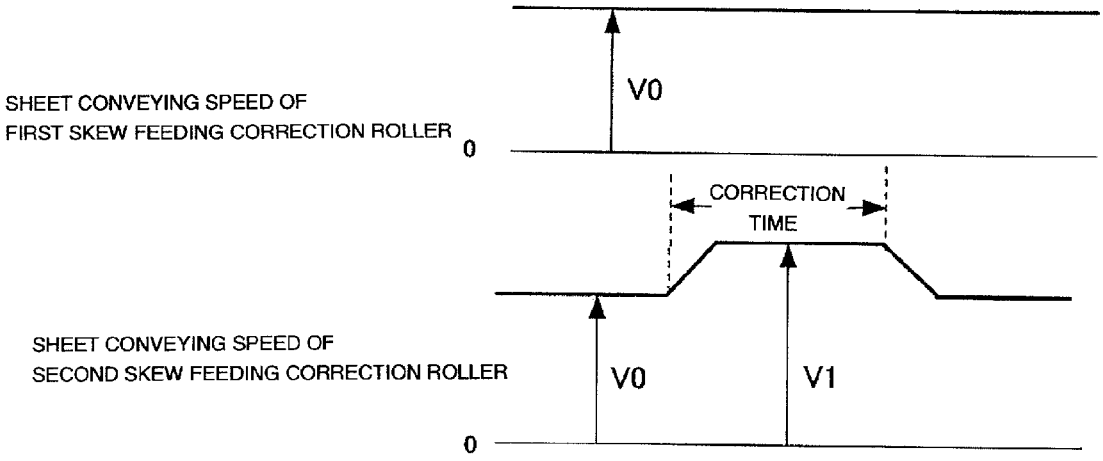

In such a lag state, as shown in FIG. 8B, the second variable speed computing portion 103L computes the target sheet conveying speed V1 of the second skew feeding correction roller 2L. This target speed V1 is increased from the steady speed V0 of the roller 2L so as to correct for the lag state. Therefore, the second sensor side (L side) of the sheet is advanced, and the skew feeding correction can be finished in the state in which the sheet lag amount becomes smaller than it would have been had the skew feeding correction been done by reducing the speed of the first skew feeding correction roller 2R (as a first mode). In this way, the drives of the first and second skew feeding correction rollers 2R and 2L are controlled such that an amount of the lag or lead of the sheet after correction of the skew feed of the sheet becomes smaller than the amount of lag or lead at the reference position (i.e., as determined by the comparative determination portion 101).

Figure 9A:
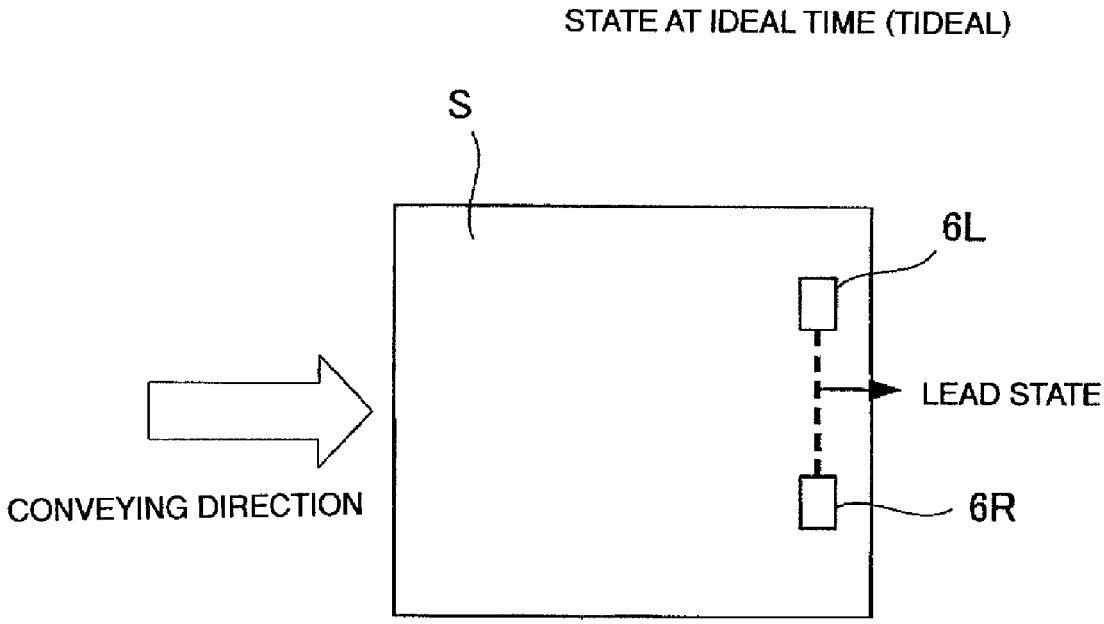
FIG. 9 is a fifth view illustrating the control operation of the first drive control portion of the skew feeding correction roller.
Figure 9B:
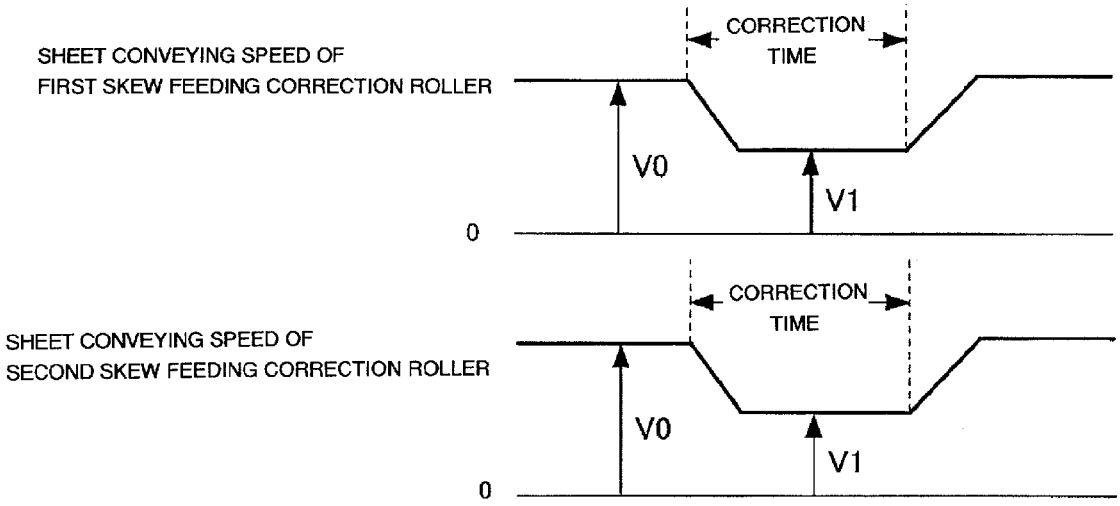

As shown in FIG. 9A, when the sheet S is in the lead state (that is, it passes the reference position before the ideal time TIDEAL) but no skew feeding is occurring, the preceding/following flag R becomes 1 and the lag/lead flag becomes 1 as a result of the comparisons performed by the comparative determination portion 101. In such a case, the first and second variable speed computing portions 103R and 103L set the target speeds V1 for both the first and second skew feeding correction rollers 2R and 2L from speed-reducing widths computed based on the lag/lead amount so as to correct for the lead state as shown in FIG. 9B. Therefore, the sheet is lagged, and the sheet leaves the skew feeding correction rollers in the state in which the sheet lead amount becomes smaller. No skew feeding correction is performed in this case.

Figure 10A:
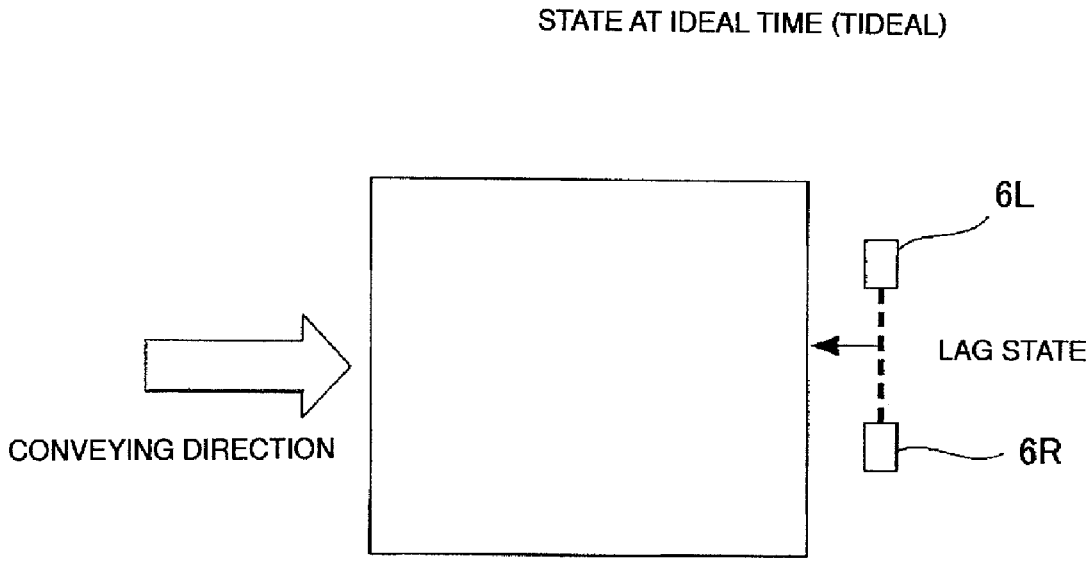
FIG. 10 is a sixth view illustrating the control operation of the first drive control portion of the skew feeding correction roller.
Figure 10B:
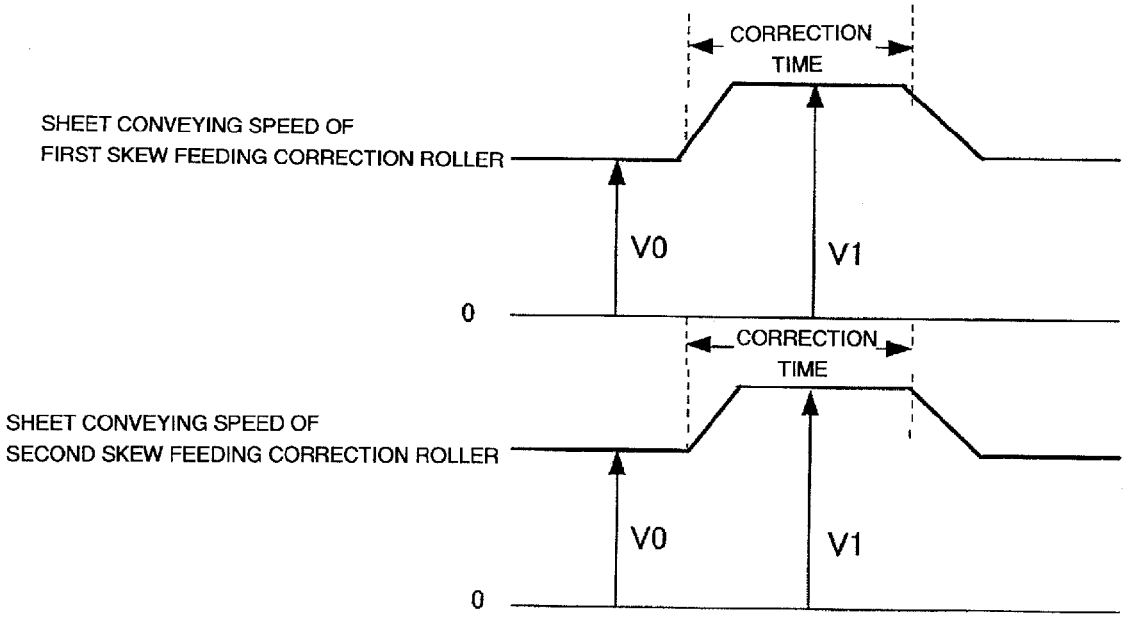

On the contrary, as shown in FIG. 10A, when the sheet S is in the lag state (that is, the sheet passes the reference position after the ideal time TIDEAL) but no skew feeding is occurring, the preceding/following flag R becomes 1 and the lag/lead flag becomes 0 as a result of the comparisons performed by the comparative determination portion 101. In such a case, the first and second variable speed computing portions 103R and 103L set the target speeds V1 for both the first and second skew feeding correction rollers 2R and 2L from speed-increasing widths computed based on the lag/lead amount so as to correct for the lag state as shown in FIG. 10B. Therefore, the sheet is advanced, and the sheet leaves the skew feeding correction rollers in the state in which the sheet lag amount becomes smaller. No skew feeding correction is performed in this case.

Thus, by controlling the sheet conveying speed of one or both of the first and second skew feeding correction rollers 2R and 2L of the first drive control portion 9 the skew feeding correction can be finished in the state in which the sheet lag amount or sheet lead amount becomes smaller. Then, the sheet S is nipped by the front-end registration roller 1. The front-end registration roller 1 is started up when the sheet S passes through a sensor (not shown) disposed near the upstream of the front-end registration roller 1. Then, the counter 200 of FIG. 4 latches the count value at the time the sheet S passes through the first sensor portion 5.

Then, the comparative determination portion 201 compares the count value from the counter 200 to the ideal count value (TIDEAL2) at which the sheet S should pass through the first sensor portion 5 to align the toner image 31 with the sheet S. Therefore, the comparative determination portion 201 outputs the lag/lead flag (lead: 1 or lag: 0) and the lag/lead amount.

Figure 11A:
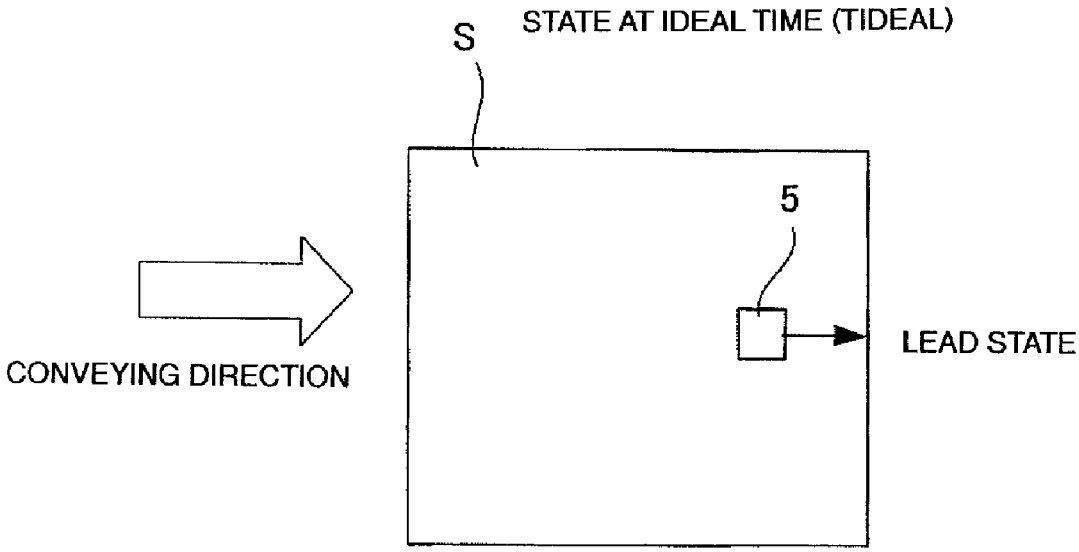
FIG. 11 is a seventh view illustrating the control operation of the first drive control portion of the skew feeding correction roller.
Figure 11B:
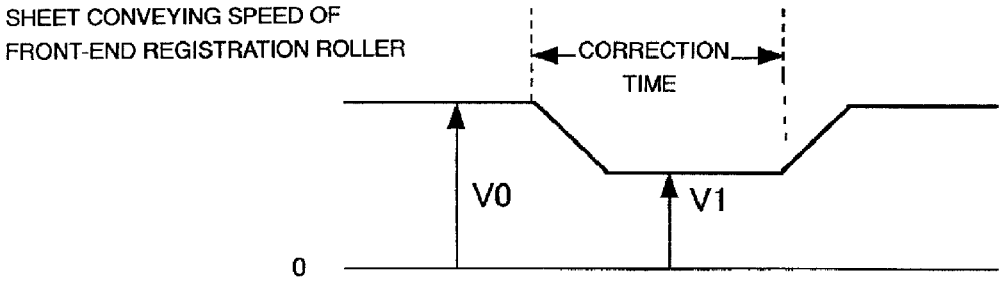

When the sheet S is in the lead state, the lag/lead flag becomes 1 as shown in FIG. 11A, and the variable speed computing portion 202 sets the target sheet conveying speed V1 of the front-end registration roller 1. This target speed V1 is reduced so as to correct for the lead state as shown in FIG. 11B.

Figure 12A:
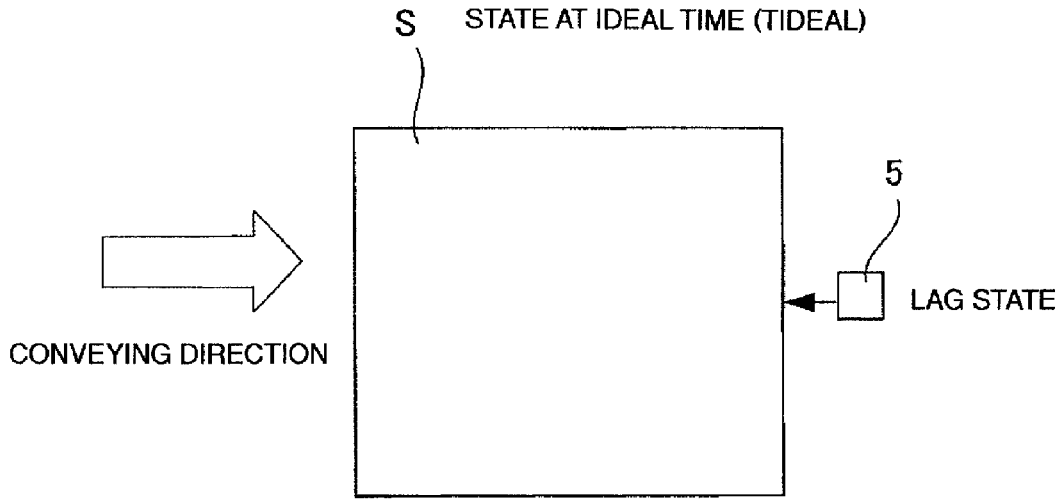
FIG. 12 is an eighth view illustrating the control operation of the first drive control portion of the skew feeding correction roller.
Figure 12B:
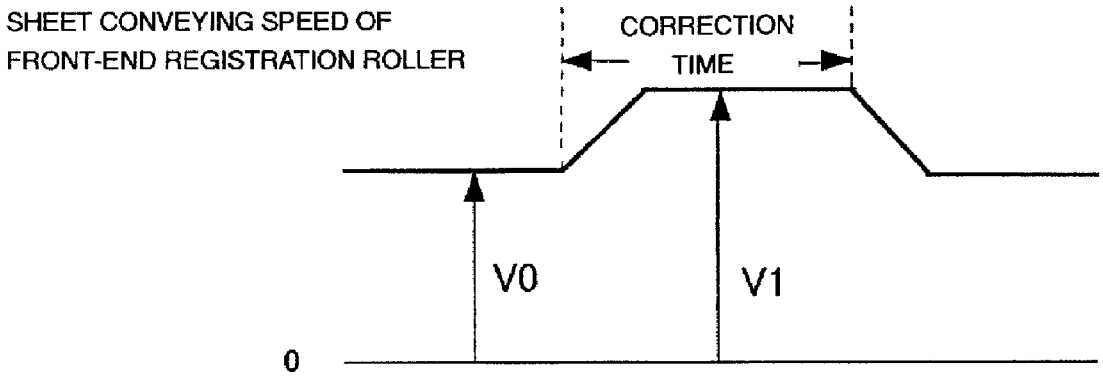

On the contrary, when the sheet S is in the lag state, the lag/lead flag becomes 0 as shown in FIG. 12A, and the variable speed computing portion 202 sets the target sheet conveying speed V1 of the front-end registration roller 1. This target speed V1 is increased so as to correct for the lag state as shown in FIG. 12B. Accordingly, the lag or lead of the sheet is corrected using the target speed V1. Subsequently the sheet is conveyed to the second transfer portion at the steady speed V0. In this embodiment, the steady speed V0 is the same as a transfer speed at which the image is transferred onto the sheet in the second transfer portion. However, the invention is not limited to the above configuration. For example, the steady speed V0 can beset faster than the transfer speed, and the speed of the sheet can be reduced from the steady speed to the transfer speed, whilst still correcting for the lag or lead of the sheet.

At this point, by increasing or reducing the sheet conveying speed of the front-end registration roller 1, the sheet S is conveyed while the sheet lag or lead amount becomes smaller. Because some lag/lead correction has already been carried out using the skew feeding correction rollers, the amount of the lag/lead correction (front-end registration correction) performed by the front-end registration roller 1 is reduced. Accordingly, the decrease in accuracy of positional correction performed by the front-end registration roller 1, as mentioned in the introductory part of the present specification, can be prevented in the sheet conveying direction of the sheet S.

Thus, when it is determined that the passage of the sheet through the reference position is lagged, the sheet conveying speed of the skew feeding correction roller corresponding to the side on which the front end of the sheet is lagged in the sheet conveying direction is increased to correct the skew feeding, so that the worsening of the sheet conveying lag can be prevented.

When it is determined that the passage of the sheet through the reference position is advanced, the sheet conveying speed of the skew feeding correction roller corresponding to the side on which the front end of the sheet is advanced in the sheet conveying direction is reduced to correct the skew feeding, so that the increase in the sheet conveying lead can be prevented. Therefore, the sheet skew feeding can be corrected while the sheet conveying lag/lead amount is reduced.

In the above-described embodiment, the sheet conveying speeds of the first and second skew feeding correction rollers 2R and 2L are controlled in dependence upon whether the sheet is detected as having a lag state or a lead state. After the skew feeding correction, a further correction for any residual lag/lead state is carried out on the sheet using the downstream correction roller (front-end registration roller 1). Alternatively, the sheet conveying speeds of the first and second skew feeding correction rollers 2R and 2L may be controlled such that the correction for the sheet skew feeding and the correction for sheet conveying lag or lead are simultaneously performed by the skew feeding correction rollers. In this case, it may be possible to dispense with the further correction carried out by the downstream correction roller.

A second embodiment of the invention will be described below. In the second embodiment, the sheet conveying speeds of the first and second skew feeding correction rollers 2R and 2L are controlled such that the correction for the sheet skew feeding and the correction for the sheet conveying lag or lead are simultaneously performed by the skew feeding correction rollers.

FIG. 13 is a view illustrating a control operation of a skew feeding correction roller provided in an image forming apparatus of the second embodiment.

Figure 13A:
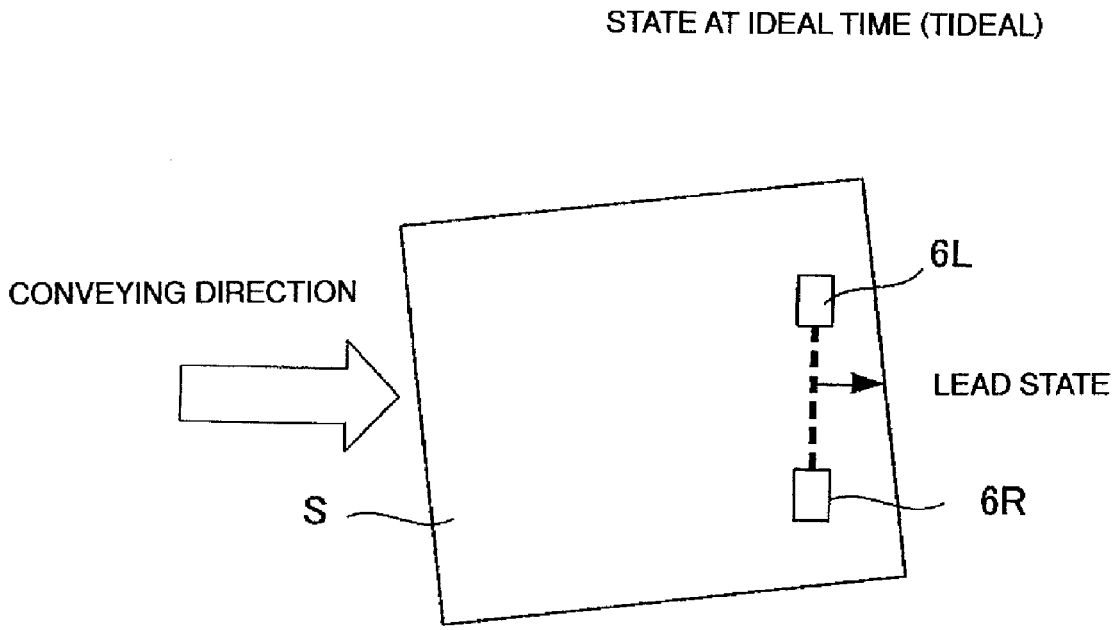
FIG. 13 is a first view illustrating control operation of a first drive control portion of a skew feeding correction roller provided in a image forming apparatus according to a second embodiment of the invention.

FIG. 13A shows a state in which the sheet S is in the lead state and the sheet S passes through the first sensor 6R before the second sensor 6L. At this point, as a result of the comparisons performed by the comparative determination portion 101, the preceding/following flag R becomes 1 and the lag/lead flag becomes 1.

Figure 13B:
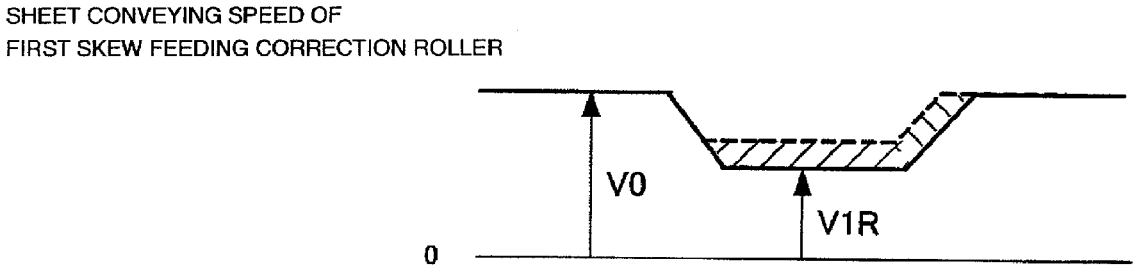

In such a case, as shown in FIG. 13B, the first variable speed computing portion 103R controls the first skew feeding correction roller 2R such that the conveying speed of the first skew feeding correction roller 2R is decreased from the steady speed V0 to a target speed V1R. In this embodiment the speed decrease is obtained by adding a lead correction amount (shaded region) to a basic speed-reducing correction amount (broken line). This basic speed-reducing correction amount is half a skew feeding amount.

Figure 13C:
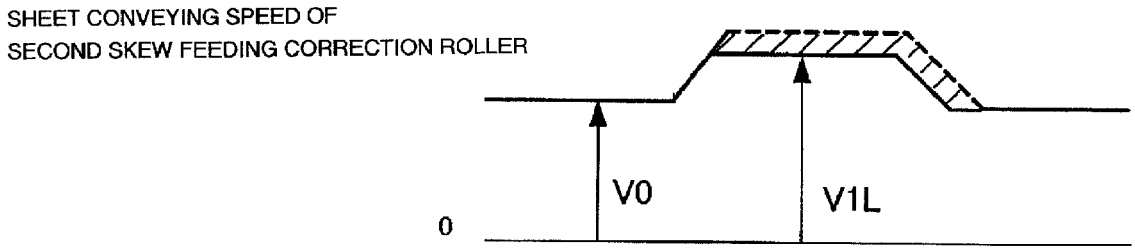

As shown in FIG. 13C, the second variable speed computing portion 103L controls the second skew feeding correction roller 2L such that the conveying speed of the first skew feeding correction roller 2R is increased from the steady speed V0 to a target speed V1L. The speed increase is obtained by subtracting the lead correction amount (shaded region) from a basic speed-increasing correction amount (broken line). This basic speed-increasing correction amount is half the skew feeding amount.

That is, when it is determined that the passage of the sheet through the reference position is advanced, the sheet conveying speed of the first skew feeding correction roller 2R is reduced from the steady speed V0 to a skew-and-lead correcting speed V1R. The speed decrease V0-V1R is obtained by adding a speed-reducing correction amount for correcting the sheet lead to a speed-reducing correction amount for correcting half the skew feeding amount. The sheet conveying speed of the skew feeding correction roller 2L is increased to a skew-and-lead correcting speed V1L. The speed increase V1L-V0 is obtained by subtracting a speed-reducing correction amount for correcting the sheet lead from a speed-increasing correction amount for correcting half the skew feeding amount. In other words, because of the lead state, the amount of the speed decrease is increased and the amount of the speed increase is decreased. Accordingly, both V1R and V1L are lower than they would have been had the lead state not been taken into account.

Therefore, the skew feeding correction and the sheet conveying lead correction can simultaneously be performed by the first and second skew feeding correction rollers 2R and 2L. As a result, the correction amount performed by the front-end registration roller 1 is decreased, so that the decrease in accuracy of positional correction performed by the front-end registration roller 1 can be prevented in the sheet conveying direction of the sheet S.

Figure 14A:
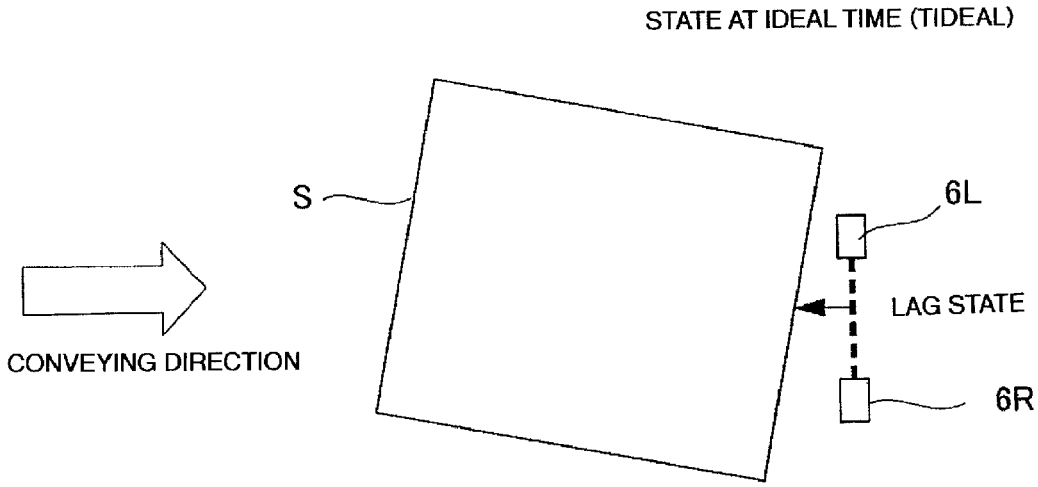
FIG. 14 is a second view illustrating the control operation of the first drive control portion of the skew feeding correction roller provided in the image forming apparatus of the second embodiment.

On the contrary, as shown in FIG. 14A, when the sheet S is in the lag state and the sheet S passes through the second sensor 6L before the first sensor 6R, the preceding/following flag R becomes 0 and the lag/lead flag becomes 0.

Figure 14B:
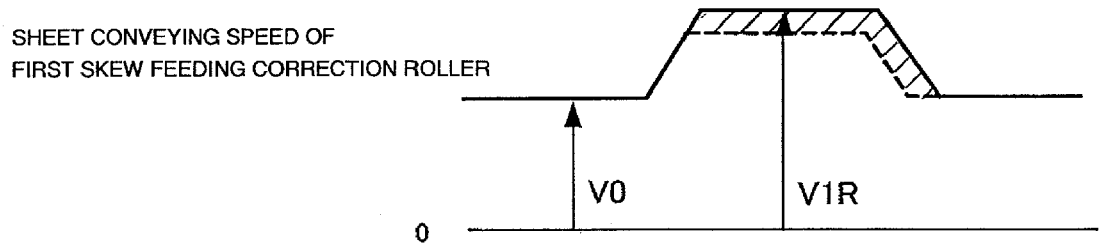

In such a case, as shown in FIG. 14B, the first variable speed computing portion 103R controls the first skew feeding correction roller 2R such that the conveying speed of the first skew feeding correction roller 2R is increased from the steady speed V0 to the target speed V1R. The speed increase is obtained by adding a lead correction amount (shaded region) to a basic speed-reducing correction amount (broken line). This basic speed-reducing correction amount is half of a skew feeding amount.

Figure 14C:
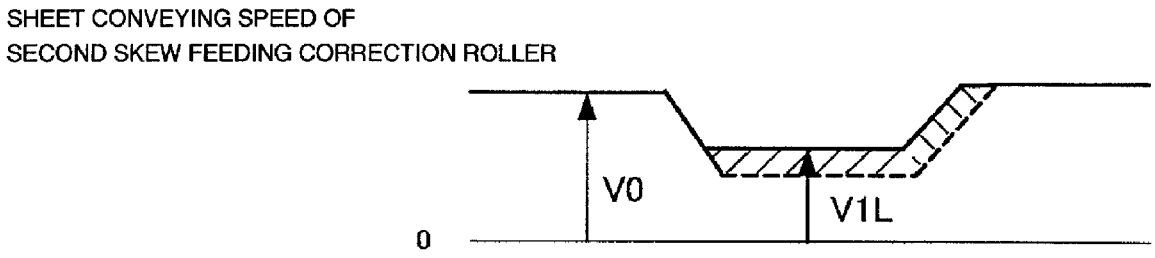
Figure 15:
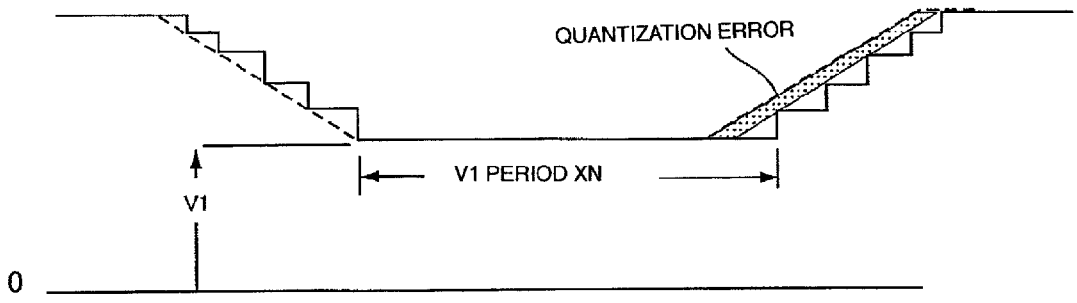
FIG. 15 is a view illustrating an error in roller drive control.

As shown in FIG. 14C, the second variable speed computing portion 103L controls the second skew feeding correction roller 2L such that the conveying speed of the second skew feeding correction roller 2L is decreased from the steady speed V0 to the target speed V1L. The speed decrease is obtained by subtracting the lag correction amount (shaded region) from a basic speed-reducing correction amount (broken line). This basic speed-reducing correction amount is half the skew feeding amount.

That is, when it is determined that the passage of the sheet through the reference position is lagged, the sheet conveying speed of the first skew feeding correction roller 2R is increased from the steady speed V0 to a skew-and-lag correcting speed V1R. The amount of the speed increase is obtained by adding a speed-increasing correction amount for correcting half the skew feeding amount to a speed-increasing correction for correcting the sheet lag. The sheet conveying speed of the skew feeding correction roller 2L is reduced from the steady speed V0 to a skew-and-lag correcting speed V1L. The amount of the speed decrease is obtained by subtracting a speed-increasing correction for correcting the sheet lag from a speed-reducing correction for correcting half the skew feeding amount. In other words, because of the lag state, the amount of the speed increase is increased and the amount of the speed decrease is decreased. Accordingly, both V1R and V1L are higher than they would have been had the lag state not been taken into account.

Therefore, the skew feeding correction and the sheet conveying lag correction can simultaneously be performed while the sheet is rotated by the first and second skew feeding correction rollers 2R and 2L. As a result, the amount of lag/lead correction to be performed by the front-end registration roller 1 is decreased, or eliminated altogether, so that the decrease in accuracy of positional correction performed by the front-end registration roller 1 can be prevented in the sheet conveying direction of the sheet S.

In the above embodiments, the speed-increasing correction amount and the reducing correction amount for correcting the skew of the sheet are respectively set for correcting a half of a skew amount. However, the invention is not limited to the above configuration.

In the above embodiments, the front end of the sheet is detected by the two first and second sensors 6R and 6L. However, this is merely one example of the configuration for detecting the sheet skew feeding amount. The invention is not limited to the above configuration. For example, a line sensor in which CCD (Charge Coupled Device) is utilized may be disposed in the direction orthogonal to the sheet conveying direction to detect the front end of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-327528, filed Dec. 4, 2006, which is hereby incorporated by reference herein in its entirety.

What is claimed is:

1. The sheet conveying apparatus comprising:

a skew feeding detection unit arranged along a sheet conveying path which detects a skew-feeding state of a conveyed sheet;

a skew feeding correction device, arranged along the sheet conveying path, and comprising first and second skew feeding correction rollers that are drivable independently and are arranged respectively at a direction orthogonal to a sheet conveying direction:

a drive control unit operable to control driving of the skew feeding correction rollers so as to correct for the skew feeding of the sheet based on a direction by the skew feeding detection unit; and a lag/lead state detection unit which detects whether such a conveyed sheet reaches a reference position disposed at the sheet conveying path in a lag state in which conveyance of the sheet is lagging, or in a lead state in which conveyance of the sheet is leading;

wherein the drive control unit are operable to control said driving of the skew feeding correction rollers in dependence upon the detected lag state or lead state such that an amount of the lag or lead of the sheet after such skew feeding correction by the skew feeding correction device becomes smaller than that at the reference position, wherein the drive control unit are operable to control said driving in a first mode when the sheet is detected by the lag/lead state detection unit as having said lag state, and to control said driving in a second mode, different from the first mode, when the sheet is detected as having said lead state, and wherein said first mode involves increasing a rotation speed of one roller of the first and second feeding correction rollers whose contact position is on the side of the conveyed sheet which is lagging from its normal speed and a rotation speed of the other roller of the first and second feeding correction rollers is not decreased from its normal speed, and wherein said second mode involves decreasing a rotation speed of one roller of the first and second feeding correction rollers whose contact position is on the side of the conveyed sheet which is leading from its normal speed and a rotation speed of the other roller of the first and second feeding correction rollers is not increased from its normal speed.

2. The sheet conveying apparatus comprising:

a skew feeding detection unit arranged along a sheet conveying path which detects a skew-feeding state of a conveyed sheet;

a skew feeding correction device, arranged along the sheet conveying path, and comprising first and second skew feeding correction rollers that are drivable independently and are arranged respectively at a direction orthogonal to a sheet conveying direction;

a drive control unit operable to control driving of the skew feeding correction rollers so as to correct for the skew feeding of the sheet based on a direction by the skew feeding detection unit; and a lag/lead state detection unit which detects whether such a conveyed sheet reaches a reference position disposed at the sheet conveying path in a lag state in which conveyance of the sheet is lagging, or in a lead state in which conveyance of the sheet is leading, wherein the drive control unit are operable to control said driving of the skew feeding correction rollers in dependence upon the detected lag state or lead state such that an amount of the lag or lead of the sheet after such skew feeding correction by the skew feeding correction device becomes smaller than that at the reference position, wherein the drive control unit are operable to control said driving in a first mode when the sheet is detected by the lag/lead state detection unit as having said lag state, and to control said driving in a second mode, different from the first mode, when the sheet is detected as having said lead state, and wherein said first mode involves increasing a rotation speed of one roller of the first and second feeding correction rollers whose contact position is on the side of the conveyed sheet which is lagging from its normal speed, and wherein said second mode involves decreasing a rotation speed of one roller of the first and second feeding correction rollers whose contact position is on the side of the conveyed sheet which is leading from its normal speed, and wherein in each of said first and second modes a rotation speed of the other roller of the first and second feeding corrections roller is left substantially unchanged from its normal speed.

3. The sheet conveying apparatus comprising:

a skew feeding detection unit arranged along a sheet conveying path which detects a skew-feeding state of a conveyed sheet;

a skew feeding correction device, arranged along the sheet conveying path, and comprising first and second skew feeding correction rollers that are drivable independently and are arranged respectively at a direction orthogonal to a sheet conveying direction;

a drive control unit operable to control driving of the skew feeding correction rollers so as to correct for the skew feeding of the sheet based on a direction by the skew feeding detection unit; and a lag/lead state detection unit which detects whether such a conveyed sheet reaches a reference position disposed at the sheet conveying path in a lag state in which conveyance of the sheet is lagging, or in a lead state in which conveyance of the sheet is leading, wherein the drive control unit are operable to control said driving of the skew feeding correction rollers in dependence upon the detected lag state or lead state such that an amount of the lag or lead of the sheet after such skew feeding correction by the skew feeding correction device becomes smaller than that at the reference position, wherein the drive control unit are operable to control said driving in a first mode when the sheet is detected by the lag/lead state detection unit as having said lag state, and to control said driving in a second mode, different from the first mode, when the sheet is detected as having said lead state, and wherein each of said first and second modes involves determining a speed increase for one of the first and second feeding correction rollers and a speed decrease for the other of those rollers, in said first mode an amount of the speed increase is increased by a lag correction amount and an amount of the speed decrease is decreased by the lag correction amount; and in said second mode an amount of the speed increase is decreased by a lead correction amount and an amount of the speed decrease is increased by the lead correction amount.

4. The sheet conveying apparatus according to claim 3, wherein said lag correction amount is dependent upon an amount of lag of the conveyed sheet and said lead correction amount is dependent upon an amount of lead of the conveyed sheet.

5. Image forming apparatus comprising:

a skew feeding detection unit arranged along a sheet conveying path which detects a skew-feeding state of a conveyed sheet;

a skew feeding correction device, arranged along the sheet conveying path, and comprising first and second skew feeding correction rollers that are drivable independently and are arranged respectively at a direction orthogonal to a sheet conveying direction;

a drive control unit operable to control driving of the skew feeding correction rollers so as to correct for the skew feeding of the sheet based on a direction by the skew feeding detection unit;

an image forming portion operable to form an image and to transfer the image onto a conveyed sheet following correction of skew feeding by the skew feeding correction device, and a lag/lead state detection unit which detects whether such a conveyed sheet reaches a reference position disposed along the sheet conveying path in a lag state in which conveyance of the sheet is lagging, or in a lead state in which conveyance of the sheet is leading, wherein the reference position is set in order to determine whether the sheet, on which the image is to be transferred at a transfer portion of the image forming portion, is being conveyed with the lag or the lead, wherein the drive control unit are operable to control said driving of the skew feeding correction rollers in dependence upon the detected lag state or lead state such that an amount of the lag or lead of the sheet after such skew feeding correction by the skew feeding correction device becomes smaller than that at the reference position, wherein the lag/lead state detection unit comprises, a passing timing detection unit which detects a timing at which the conveyed sheet passes the reference position; and a comparative determination unit which makes a determination of an amount of lag or lead of the sheet at the reference position based on a detection result of the passing timing detection unit, and wherein the drive control unit are operable to control said driving of the skew feeding correction rollers so that a sheet conveying speed of the skew feeding correction roller corresponding to a side on which a front end of the sheet is lagging in the sheet conveying direction is increased to be greater than a sheet conveying speed of the sheet which is conveyed to the skew feeding correction rollers and so that a sheet conveying speed of the skew feeding correction roller corresponding to a side on which the front end of the sheet is leading in the sheet conveying direction is reduced to be less than a sheet conveying speed of the sheet which is conveyed to the skew feeding correction rollers, and when the comparative determination unit determine that the passage of the sheet through the reference position is lagging, a sheet conveying speed of the skew feeding correction roller corresponding to the side on which the front end of the sheet is lagging in the sheet conveying direction is controlled to be a first skew-and-lag correcting speed obtained by adding an increased speed for correcting the skew of the sheet to an increased speed for correcting the sheet lag, and a sheet conveying speed of the skew feeding correction roller corresponding to the side on which the front end of the sheet is leading in the sheet conveying direction is controlled to be a second skew-and-lag correcting speed obtained by adding a reduced speed for correcting the skew of the sheet to an increased speed for correcting the sheet lag, and when the comparative determination unit determine that the passage of the sheet through the reference position is leading, a sheet conveying speed of the skew feeding correction roller corresponding to the side on which the front end of the sheet is leading in the sheet conveying direction is controlled to be a first skew-and-lead correcting speed obtained by adding a reduced speed for correcting the skew of the sheet to a reduced speed for correcting the sheet lead, and a sheet conveying speed of the skew feeding correction roller corresponding to the side on which the front end of the sheet is lagging in the sheet conveying direction is controlled to be a second skew-and-lead correcting speed obtained by adding an increased speed for correcting the skew of the sheet to a reduced speed for correcting the sheet lead.

6. The image forming apparatus according to claim 5, wherein the increased speed and the reduced speed for correcting the skew of the sheet are respectively set for correcting a half of a skew amount.

7. The image forming apparatus comprising:

a skew feeding detection unit arranged along a sheet conveying path which detects a skew-feeding state of a conveyed sheet;

a skew feeding correction device, arranged along the sheet conveying path, and comprising first and second skew feeding correction rollers that are drivable independently and are arranged respectively at a direction orthogonal to a sheet conveying direction;

a drive control unit operable to control driving of the skew feeding correction rollers so as to correct for the skew feeding of the sheet based on a direction by the skew feeding detection unit;

an image forming portion operable to form an image and to transfer the image onto a conveyed sheet following correction of skew feeding by the skew feeding correction device;

a lag/lead state detection unit which detects whether such a conveyed sheet reaches a reference position disposed along the sheet conveying path in a lag state in which conveyance of the sheet is lagging, or in a lead state in which conveyance of the sheet is leading, wherein the reference position is set in order to determine whether the sheet, on which the image is to be transferred at a transfer portion of the image forming portion, is being conveyed with the lag or the lead and wherein the drive control unit are operable to control said driving of the skew feeding correction rollers in dependence upon the detected lag state or lead state such that an amount of the lag or lead of the sheet after such skew feeding correction by the skew feeding correction device becomes smaller than that at the reference position;

a sheet conveying device, arranged between said skew feeding correction device and said image forming portion, which conveys the sheet after skew feeding correction by the skew feeding correction device, a sheet position detection unit which detects whether a front end of the sheet after skew feeding correction is lagging or leading, and a further drive control unit connected to the sheet conveying device and operable, when the sheet after skew feeding correction is detected as lagging, to increase a sheet conveying speed of the sheet conveying device, and further operable, when the sheet after skew feeding correction is detected as leading, to reduce a sheet conveying speed of the sheet conveying device.

* * * * *